US005997116A

United States Patent [19]

Schmidt

[11] Patent Number: 5,997,116

[45] Date of Patent: Dec. 7, 1999

[54] ROLLING TOOLBOX WITH SELECTIVE LATCH

[75] Inventor: LaVern D. Schmidt, Montezuma, Kans.

[73] Assignee: Montezuma Welding & Mfg., Inc., Montezuma, Kans.

[21] Appl. No.: 09/034,131

[22] Filed: Mar. 3, 1998

Related U.S. Application Data

[63] Continuation-in-part of application No. 08/934,182, Sep. 19, 1997, Pat. No. 5,927,837.

[51] Int. Cl.[6] ..... A47B 46/00

[52] U.S. Cl. ..... 312/249.11; 206/373; 292/89; 292/209; 312/289; 312/324

[58] Field of Search ..... 312/283, 287, 312/289, 249.8, 249.9, 249.11, 209, 317.1, 317.2, 324, 249.12, 249.13, 244, 310, 311, 321.5, 327, 329, 215, 222, 334.27, 334.33, 334.45; 206/372, 373, 47.34, 47.35, 33.992, 33.991, 33.998; 211/70.6, 90.01, 88.01; 292/87, 89, 209, 107

[56] References Cited

U.S. PATENT DOCUMENTS

| | | | |
|---|---|---|---|
| 1,784,584 | 12/1930 | Dunning . | |
| 2,564,949 | 8/1951 | Bell . | |
| 2,683,642 | 7/1954 | Stoleson . | |
| 2,870,904 | 1/1959 | Tarbox | 312/300 X |
| 3,092,428 | 6/1963 | Kerschner . | |
| 4,285,556 | 8/1981 | Loeffel . | |
| 4,389,077 | 6/1983 | Schmidt . | |
| 4,705,315 | 11/1987 | Cherry . | |
| 4,733,703 | 3/1988 | Cimino . | |
| 5,148,917 | 9/1992 | LeBrun . | |
| 5,456,358 | 10/1995 | Schmidt . | |
| 5,573,116 | 11/1996 | Zink . | |

FOREIGN PATENT DOCUMENTS

| | | |
|---|---|---|
| 2132074 | 7/1984 | United Kingdom . |

*Primary Examiner*—Janet M. Wilkens
*Attorney, Agent, or Firm*—Shook, Hardy & Bacon L.L.P.

[57] ABSTRACT

A rolling toolbox is provided which has a generally rectangular frame. The frame forms an interior compartment and has a front plate, a rear plate and opposing end plates mounted thereon. The front plate has an opening therein. Mounted to the frame in pivotal relationship is at least one bin which has an end plate, a retaining plate and opposing side plates. Mounted to the retaining plate is a rearwardly extending latch. A drawer is slidingly received within the frame through the drawer opening. The drawer has a handle extending upwardly therefrom. The handle of the drawer matingly fits with the latch of the bin to hold the bin in a closed position during transport of the toolbox. The bin may be opened by pulling thereon, the latch releasing from the handle upon the application of an opening force on the bin.

6 Claims, 4 Drawing Sheets

8.
8.

ROLLING TOOLBOX WITH SELECTIVE LATCH

CROSS REFERENCE TO RELATED APPLICATIONS

This application is a continuation-in-part of, and claims the benefit of, U.S. application Ser. No. 08/934,182, filed Sep. 19, 1997 and now U.S. Pat. No. 5,927,837.

STATEMENT REGARDING FEDERALLY SPONSORED RESEARCH OR DEVELOPMENT

Not Applicable.

BACKGROUND OF THE INVENTION

This invention relates to a rolling toolbox, and more specifically, to a rolling toolbox which can be fully opened at a job site and which can be securely closed so that its contents do not shift during transport.

Toolboxes are used every day by craftsmen, such as mechanics. Often times, these toolboxes are equipped with wheels so that the toolbox may be at or near the job site where work is being performed. The prior art rolling toolbox is also equipped with a series of drawers which slide horizontally to an open position. Further, the prior art toolboxes may be equipped with compartments or bins. In use, these prior art toolboxes suffer from a number of disadvantages.

In use, any number of tools, such as wrenches, screw drivers and sockets are placed within the drawers or compartments of the prior art toolbox. Once at the job site, the mechanic will open the drawer containing the particular tool that is needed for the task being performed. Therefore, the mechanic must remember which particular drawer contains which particular instrument. If the mechanic does not recall the drawer in which a particular tool is housed, the mechanic will simply open a series of drawers until the correct drawer is opened. Once the drawer is open, the mechanic is often confronted with a drawer full of tools which may have shifted during transport of the toolbox to the job site. The mechanic is therefore left to sort through the tools until the correct tool is found. This procedure is time consuming and is also often frustrating. When the mechanic is done with the particular tool, he merely places it back in the particular drawer and closes the drawer. Therefore, upon reopening the drawer at the new job site, the tool may or may not be in the same location within the drawer when the drawer is reopened. Thus, the process described above must again be repeated.

Many mechanics also experience that they use a certain number of the same tools for virtually every job. Further, mechanics are often working in areas which do not allow the entire rolling toolbox to be located adjacent the work area. Therefore, the mechanic must walk back and forth from the job site to the toolbox.

Thus, a novel rolling toolbox is needed to overcome the drawbacks and shortcomings of prior rolling toolboxes. Further, a rolling toolbox is needed that allows tools to be placed within the toolbox in such a manner that the tools will not shift or be displaced during transportation. Still further, a rolling toolbox is needed that can be completely opened at the job site so that its contents can be seen by the mechanic. Further yet, a rolling toolbox is needed which allows a portion of the toolbox to be selectively opened while leaving the remainder of the toolbox closed.

BRIEF SUMMARY OF THE INVENTION

One object of the present invention is to provide a rolling toolbox which may be completely opened at a job site so that the mechanic may view the entire contents of the toolbox once at the job site.

A further object of the present invention is to provide a rolling toolbox which has a structure that allows a portion of the toolbox to be opened while the remainder of the toolbox is maintained in a closed position.

According to one aspect of the present invention, a rolling toolbox is provided which has a generally rectangular frame. The frame forms an interior compartment and has a front plate, a rear plate and opposing end plates mounted thereon. The front plate has an opening therein. Mounted to the frame in pivotal relationship is at least one bin which has an end plate, a retaining plate and opposing side plates. Mounted to the retaining plate is a rearwardly extending latch. A drawer is slidingly received within the frame through the drawer opening. The drawer has a handle extending upwardly therefrom. The handle of the drawer matingly fits with the latch of the bin to hold the bin in a closed position during transport of the toolbox. The bins may be opened by pulling thereon, the latch releasing from the handle upon the application of an opening force on the bin.

Additional objects, advantages, and novel features of the invention will be set forth in part in the description which follows and in part will become apparent to those skilled in the art upon examination of the following, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

In the accompanying drawings which form a part of the specification.

DETAILED DESCRIPTION OF THE INVENTION

Figures 7, 11:
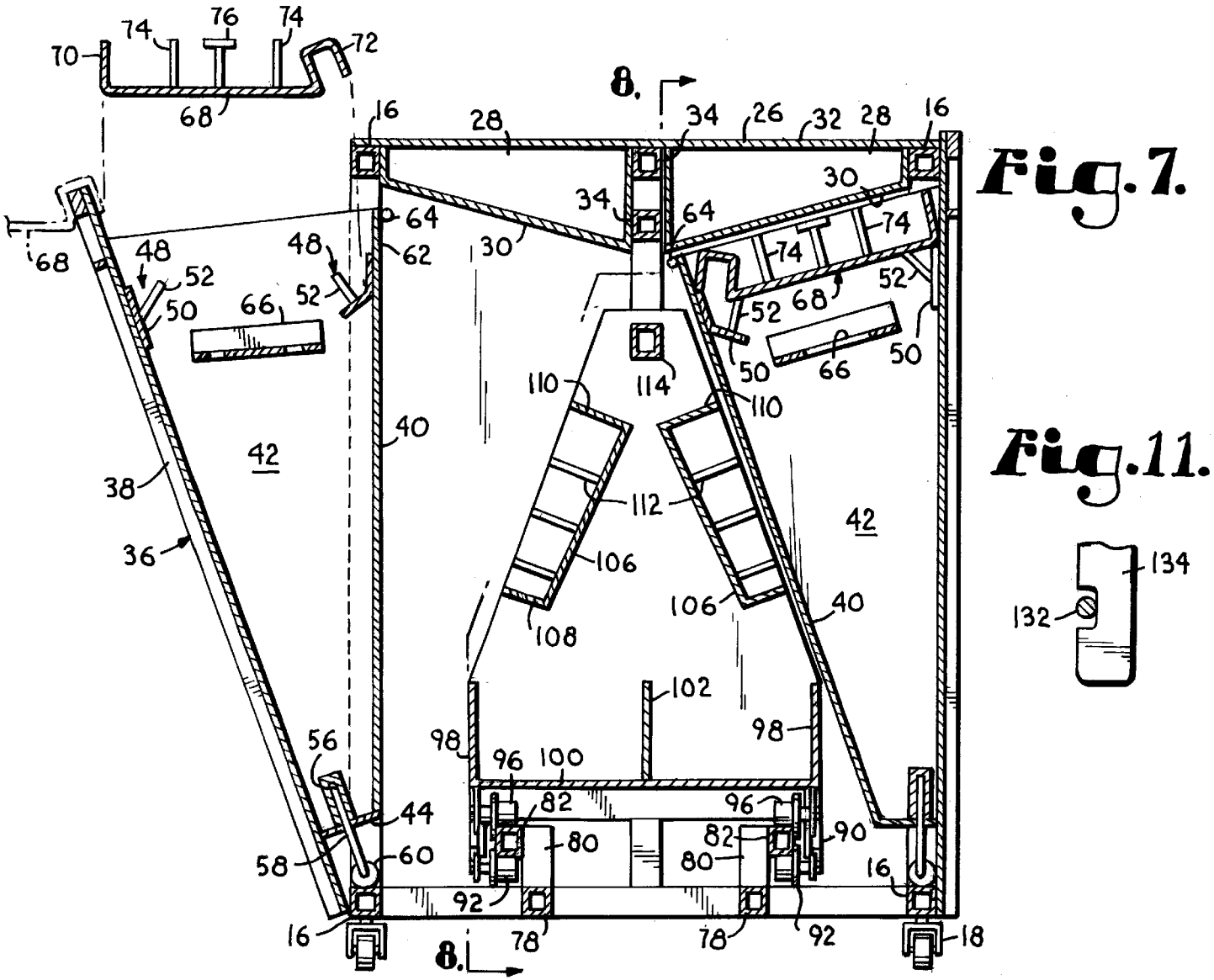
FIG. 7 is a cross-sectional view taken along line 7—7 of FIG. 1 with one of the bins in an open position.
FIG. 11 is an enlarged partial sectional view taken along line 11—11 of FIG. 9.

A rolling toolbox embodying the principles of this invention is broadly designated in the drawings by the reference numeral 10. Toolbox 10 has a generally rectangular frame 12 which is preferably made of square seal tubing. Frame 12 is made up of both vertical support pieces 14 and horizontal support pieces 16, as best seen in FIG. 7. Frame 12 is made by welding vertical support pieces 14 to horizontal support pieces 16 to form rigid frame 12. Attached to the lower surface of frame 12 near each of the four corners is a heavy-duty caster 18. At least two of casters 18 are swivel-type casters. Preferably, all four casters 18 are swivel-type casters. Casters 18 allow toolbox 10 to be easily maneuvered and transported to a particular job site. Further, at least two of the vertical support pieces 14 have a handle 20 attached near the upper end thereof. Handles 20 allow, along with casters 18, toolbox 10 to be easily maneuvered.

Figure 5:
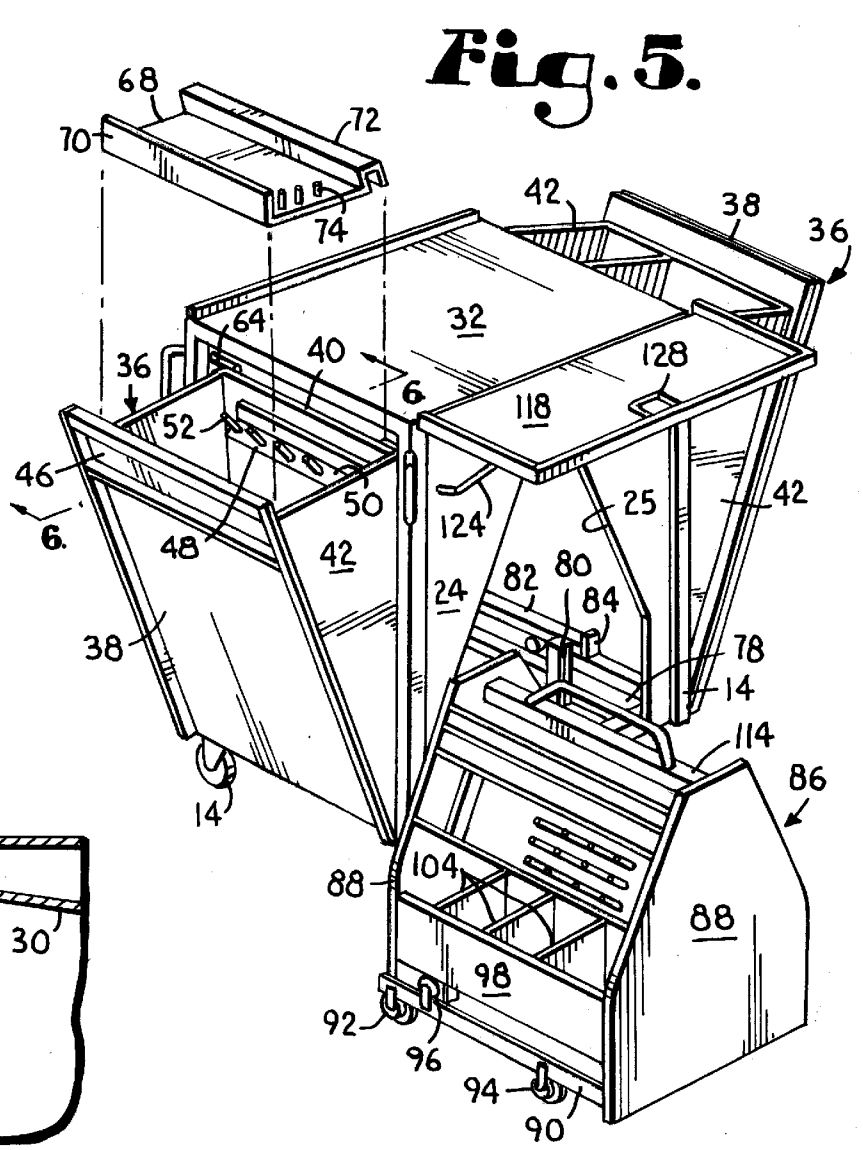
FIG. 5 is a perspective view of the rolling toolbox shown in FIG. 1 shown with the latching self in an open position, the drawer completely removed from the toolbox and the bins in an open position.
Figure 4:
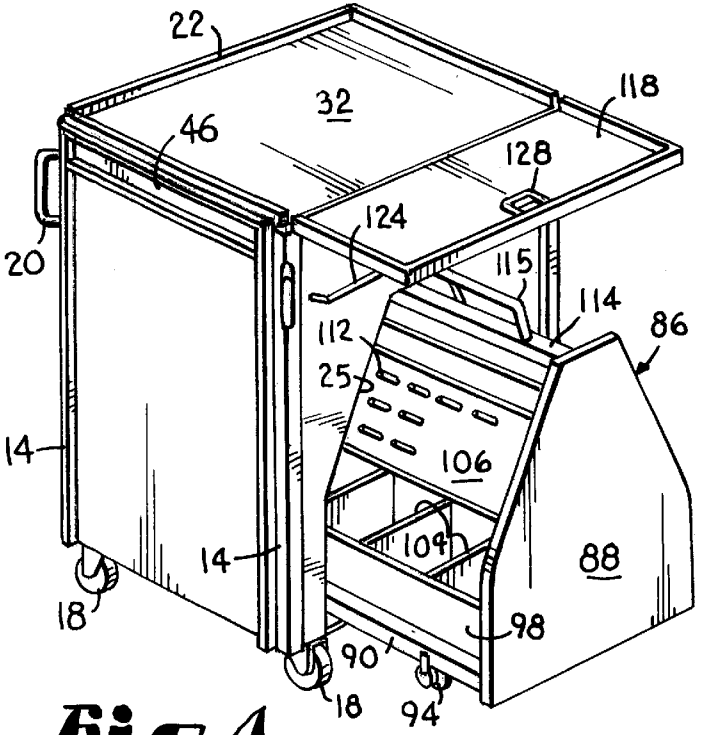
FIG. 4 is a perspective view of the toolbox shown in FIG. 1, shown with the latching shelf in an open position and the drawer in a partially open position.
Figure 8:
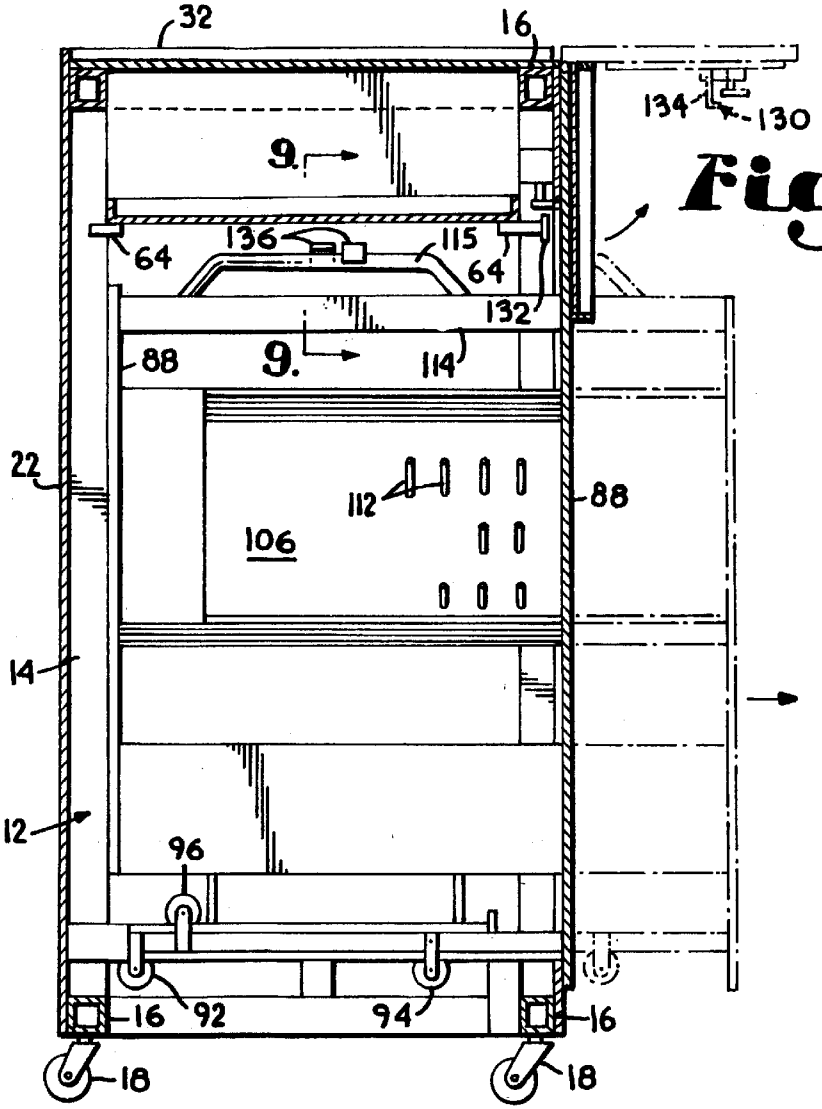
FIG. 8 is a cross-sectional view taken along line 8—8 of FIG. 7.

Coupled to frame 12 is a rear plate 22, as best seen in FIG. 8. Rear plate 22 is generally rectangular in shape and completely covers the opening formed by one side of frame 12. Opposite rear plate 22 and attached to frame 12 is a front plate 24. As best seen in FIGS. 4 and 5, front plate 24 defines an opening 25 formed therein. Rear plate 22 and front plate 24 are preferably rigidly secured to frame 12, such as by welding.

Frame 12 further has secured thereto a top section 26, as best seen in FIG. 7. Top section 26 is made by securing a pair of triangular support sections 28 having lower surfaces 30 to a top plate 32. Top plate 32 is thereafter secured to frame 12, such as by welding or by bolts. Top section 26 is further supported by horizontal cross braces 34 which act to support top section 26 and to add rigidity to frame 12. Cross braces 34 are rigidly secured to rear plate 22 on one end and front plate 24 on an opposite end.

Figure 6:
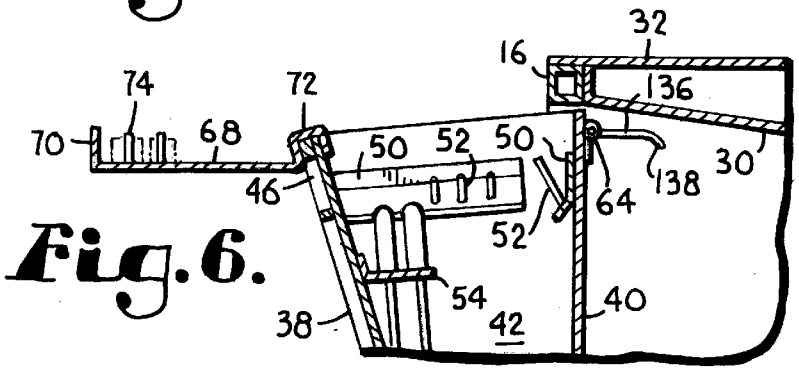
FIG. 6 is a partial sectional view of the toolbox taken along lines 6—6 of FIG. 5 and showing the tray placed on the bin.

Pivotally connected to frame 12 between rear plate 22 and front plate 24 are a pair of bins 36, as best seen in FIGS. 4 through 7. Bins 36 are used to house a variety of tools, as is more fully described below. Each bin 36 has an end plate 38, a retaining plate 40, and a pair of opposing side plates 42. End plate 38, retaining plate 40 and side plates 42 are all preferably made of sheet metal and are preferably welded together. Further, retaining plate 40 may be bent so as to form a bottom 44. Alternatively, bottom 44 may be formed from a separate plate which would then be welded to end plate 38, retaining plate 40 and side plates 42. As best seen in FIG. 7, bin 36 is generally triangular shaped in cross section. End plate 38 may have formed therein a recess area 46 to aid in the opening and closing of bin 36, as is more fully described below. Secured to the interior of bins 36 near the upper end thereof are a plurality of holding members 48. As shown in FIGS. 5 and 7, holding members 48 are formed from a holding plate 50 to which is secured a plurality of holding pins 52. In use, tools are placed over holding pins 52. Alternatively, holding members 48 may be formed from a holding plate 54, as shown in FIG. 6. A portion of holding plate 54 is rigidly secured to end plate 38 or retaining plate 40. Another portion of holding plate 54 extends into the interior of bin 36 and has formed therein a plurality of apertures (not shown) for receiving tools such as hammers and crow bars.

As stated above, bins 36 are pivotally secured to frame 12. Attached to, and extending into bin 36 is a socket 56 which can be formed from a piece of square steel tubing. As shown in FIG. 7, socket 56 extends into the interior of bin 36 and is located adjacent end plate 38. In an alternative embodiment, socket 56 is rigidly secured to retaining plate 40. Extending into sockets 56 is a pivot rod 58. Pivot rod 58 extends through a bearing 60 which is in turn rigidly secured to frame 12. Thus, pivot rod 58 is free to rotate within bearing 60. Bin 36 is held on pivot rod 58 by the force of gravity. Alternatively, pivot rod 58 may be rigidly secured to a cylindrical tube or pipe which surrounds a lower horizontal support 16 of frame 12. This alternative embodiment is not shown.

Attached to retaining plate 40 adjacent its upper end 62 is an adjustable stop 64. Adjustable stop 64 is threadedly received within a bracket. Adjustable stop 64 will abut vertical support 14 of frame 12 and allow bin 36 to be opened only as far as is shown in FIG. 7. Further, adjustable stop 64 allows bins 36 to be completely removed from frame 12. To remove bins 36, adjustable stops 64 are threaded inwardly until the stop clears vertical support 14 of frame 12 so that bin 36 may be pivoted further outwardly beyond frame 12. Thereafter, bin 36 may simply be lifted upwardly off of pivot rod 58. In order to facilitate such removal, bin 36 may be equipped with openings 66 formed in side plates 42 which act as handles.

Removably housed within bins 36 is a tray 68. Tray 68 has an upwardly extending lip 70 on one end thereof and an inverted, U-shaped bracket 72 formed on an opposite end. Tray 68 has rigidly secured thereto a plurality of upwardly extending holding pins 74. Holding pins 74 may be used to secure a variety of tools, such as sockets, in place. Tray 68 may also be equipped with a handle 76, as best seen in FIG. 7. Handle 76 facilitates removal of tray 68 from bin 36. As shown on the right side of FIG. 7, tray 68, when held within bin 36, rests upon holding pins 52 of bin 36. Thus, when tray 68 is in place, tools held on holding pins 52 will be prevented from being displaced by tray 68 when bin 36 is in a closed position. Further, when tray 68 is placed upon holding pins 52 and bin 36 is closed, holding pins 74 of tray 68 will extend generally to lower surfaces 30 of top section 26. Thus, lower surfaces 30 cooperate with holding pins 74 to insure that tools held on holding pins 74 are prevented from displacement within toolbox 10. Once rolling toolbox 10 is at a desired location, bin 36 may be pivoted to an open position and tray 68 may be removed to allow access to both the tools on tray 68 and the tools held within bins 36. Once removed from bin 36, tray 68 may be held in a cantilevered position on end plate 38 as best seen in FIG. 6 by placing U-shaped bracket 72 over end plate 38.

As best seen in FIGS. 5 and 7, extending across frame 12 from front plate 24 to rear plate 22 are a pair of horizontal cross braces 78. Cross braces 78 are located at the lower end of frame 12 and are rigidly secured thereto. Extending upwardly from each cross brace 78 is a pair of vertical supports 80 which are welded to cross braces 78. Welded to vertical supports 80 is a roller track 82. Track 82 is therefore elevated from the bottom of frame 12 and extends from rear plate 22 towards front plate 24. However, track 82 does not extend to front plate 24. Disposed on roller track 82 on the end of the track nearest front plate 24 is a stop 84 which protrudes from the top of roller track 82, as best seen in FIG. 5. Stop 84 is used to insure that a drawer 86 does not roll completely out of toolbox 10 unless desired.

Drawer 86 is carried upon roller track 82 and can slide into and out of toolbox 10. Drawer 86 has a pair of opposing end plates 88 which conform in shape to opening 25 in front plate 24. Extending between end plates 88 and welded thereto is a roller support 90. Mounted on roller support 90 is a rear lower roller 92 and a front lower roller 94. Rear lower roller 92 is located adjacent one end plate 88 and front lower roller 94 is spaced from and located nearer the other end plate 88. Located between rear lower roller 92 and front lower roller 94 is a rear upper roller 96. Roller 96 is located nearer rear lower roller 92 than front lower roller 94. Rollers 92, 94 and 96 are rigidly secured to roller support 90 but are free to rotate. Rollers 92, 94 and 96 act to support drawer 86 upon roller track 82 and allow drawer 86 to be moved into and out of toolbox 10. Stop 84 cooperates with rear upper roller 96 to prevent drawer 86 from completely coming out of toolbox 10. Thus, when drawer 86 is slid outwardly, it will be prevented from sliding completely out of toolbox 10 by stop 84 and rear upper roller 96. However, drawer 86 can be completely removed from rolling toolbox 10 when it is so desired, as is more fully described below.

Welded between end plates 88 of drawer 86 are side supports 98 and a bottom plate 100, as best seen in FIG. 7. Side supports 98 extend completely between end plates 88 and extend only a partial distance upwardly on drawer 86. A central support plate 102 may also be welded between end plates 88 on drawer 86. Central support plate 102 is best seen in FIG. 7 and adds rigidity and support to drawer 86. Extending between central support plate 102 and side supports 98 are a series of divider plates 104. Divider plates 104 cooperate with end plates 88, side supports 98 and central support plate 102 to form a series of compartments. These compartments may be used to house tools of an odd shape, such as grease-guns and extension cords. Located above side supports 98 and welded to end plates 88 is a pair of inclined holding plates 106. Holding plates 106 preferably have a lower lip 108 and an upper lip 110 extending therefrom. Lower lip 108 and upper lip 110 extend generally to the outer perimeter of end plates 88. Attached to holding plates 106 are a plurality of holding pins 112. Preferably, holding pins 112 are welded to holding plate 106 to form a right angle with holding plate 106. Therefore, holding pins 106 are generally inclined from the horizontal plane. Further, holding pins 112 extend generally to the outer perimeter of end plates 88 and are used to hold items such as sockets.

Figure 1:
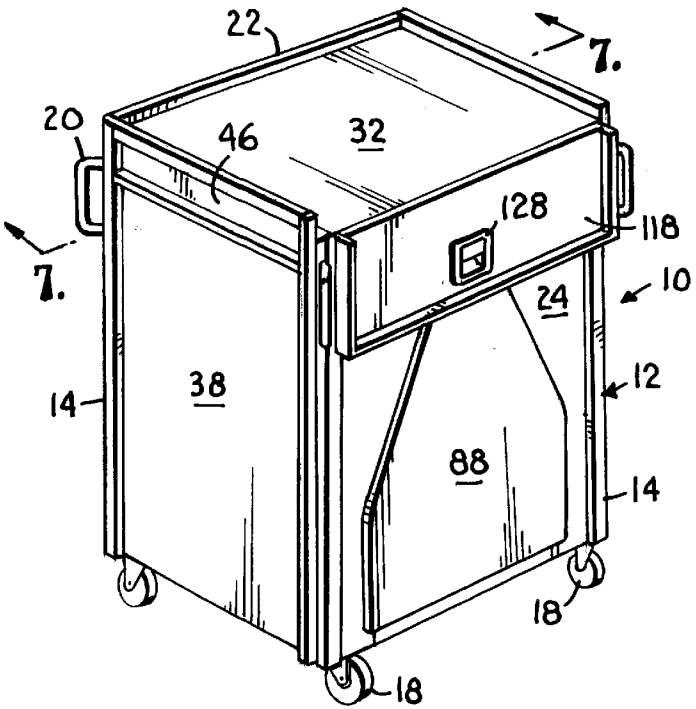
FIG. 1 is a perspective view of a rolling toolbox embodying the principles of the present invention.

Located above upper lip 110 of holding plate 106 is a handle support 114. Handle support 114 extends between end plates 88. Handle support 114 provides rigidity and support to drawer 86 as well as providing a support for a handle 115. Handle 1 15 acts as a holding mechanism for bins 36, as is more fully described below. In use, drawer 86 may be completely removed from toolbox 10, as shown in FIG. 5. To place drawer 86 into toolbox 10, drawer 86 is lifted so that rear lower roller 92 is rolling within frame 12, until rear upper roller 96 confronts stop 84. At this point, drawer 86 is inclined upwardly until rear upper roller 96 clears stop 84. Thereafter, drawer 86 is simply slid back into toolbox 10. Conversely, when drawer 86 is desired to be completely removed from toolbox 10 it is slid outwardly until rear upper roller 96 confronts stop 84. At this point, it is necessary to incline drawer 86 slightly until rear upper roller 96 clears stop 84, at which point drawer 86 may be removed from toolbox 10. As best seen in FIGS. 1, 4 and 5, end plates 88 have an outer perimeter which matches the shape of opening 25 defined by front plate 24. As best seen in FIG. 7, when drawer 86 is completely within toolbox 10, and bins 36 are in a closed position, retaining plate 40 of bin 36 is located adjacent holding pins 112, lower lip 108 and upper lip 110. Therefore, when bin 36 is in a closed position and drawer 86 is located within toolbox 10, retaining plate 40 cooperates with holding pins 112 to insure that tools held on holding pins 112 will not change position during transport.

Figure 2:
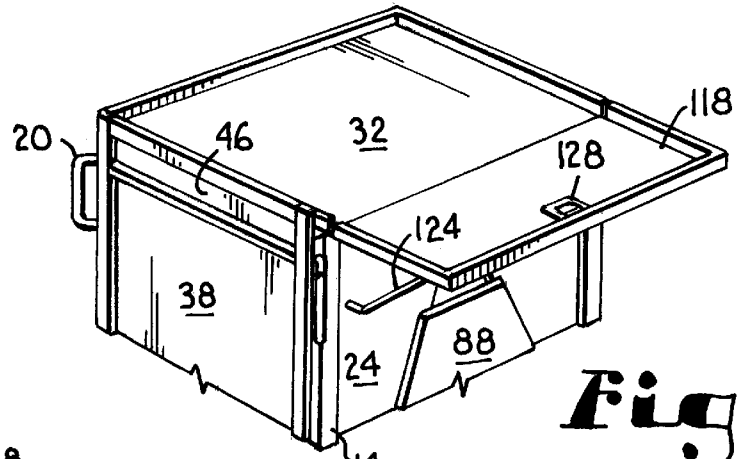
FIG. 2 is a partial perspective view of the toolbox in FIG. 1 shown with the latching shelf in an extended position.
Figure 3:
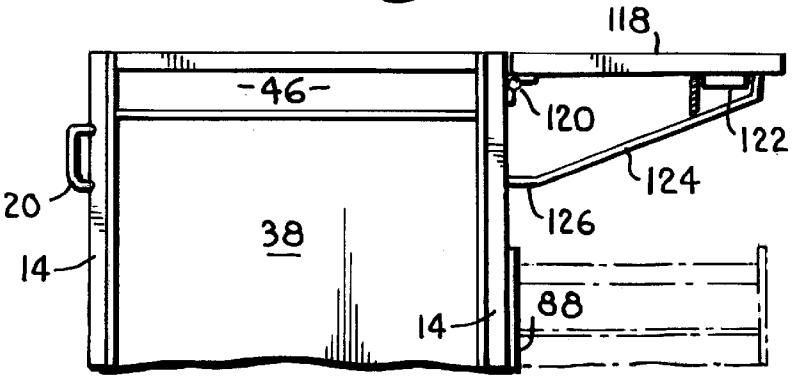
FIG. 3 is a partial side elevation view of the toolbox of FIG. 1, shown with the latching shelf in an extended position and showing the drawer in an open position in phantom lines.

As best seen in FIG. 1, when drawer 86 is completely within toolbox 10, a latching shelf 118 is disposed thereover to hold drawer 86 in a closed position. Latching shelf 118 insures that drawer 86 does not open during transport. Latching shelf 118 is hingedly connected to front plate 24 via a hinge 120, as best seen in FIG. 3. Latching shelf 118 has disposed on its rear lower surface a bracket 122 through which is disposed a shelf support 124. Shelf support 124 rotates within bracket 122. As seen in FIG. 3, shelf support 124 is rotated to a lowered position where a lower end 126 of shelf support 124 abuts front plate 24. The weight of latching shelf 118 acts upon shelf support 124 to hold latching shelf 118 in an extended position. In this position, latching shelf 118 allows drawer 86 to be opened. Further, in this position, latching shelf 118 provides a larger working surface in cooperation with top plate 32 of top section 26.

Latching shelf 118 is further equipped with a handle 128 which, when pulled upwardly, releases a latching mechanism 130 as is more fully described below. Turning now to FIGS. 8 through 11, latching mechanism 130 cooperates with a locking pin 132 which is rigidly secured to frame 12. More specifically, latching mechanism 130 has a locking arm 134 which is pivotally connected to latching shelf 118. Locking arm 134 extends rearwardly away from the lower surface of latching shelf 118. As best seen in FIG. 11, locking arm 134 has a recessed, U-shaped area which mates with locking pin 132 to hold latching shelf 118, and therefore drawer 86, in a closed position.

Figure 9:
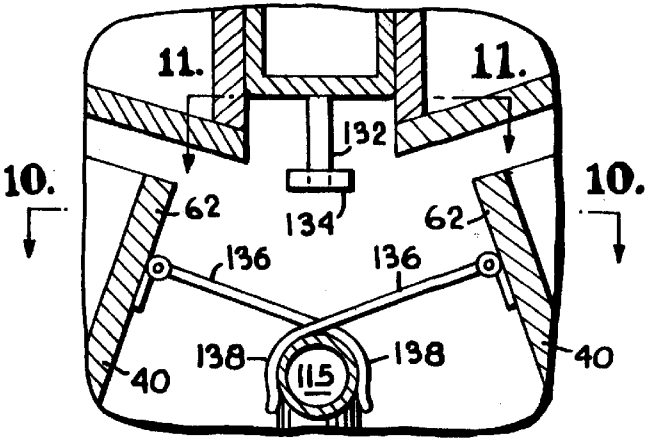
FIG. 9 is an enlarged sectional view of the latch taken along line 9—9 of FIG. 8.
Figure 10:
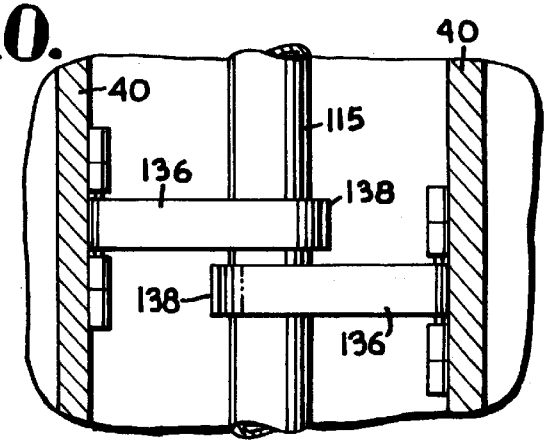
FIG. 10 is an enlarged sectional view of the latch taken along line 10—10 of FIG. 9.

As best seen in FIGS. 6–9, bins 36 have a latch 136 coupled to retaining plate 40. Latches 136 extend rearwardly away from retaining plate 40 and have a bent rearward end 138. As best seen in FIGS. 9 and 10, end 138 is bent to matingly fit over handle 115. End 138 and handle 115 thus cooperate to prevent bins 36 from moving to an open position while toolbox 10 is being transported from one job site to another. Latches 136 are typically made from a spring steel and will deform upwardly when an opening force is applied to bins 36, such as by pulling on recessed area 46. The upward movement of latch 136 allows end 138 to move away from handle 115, and thus allows bin 36 to be opened. Further, when bins 36 are moved to a closed position, ends 138 of latches 136 are cammed upwardly by the interaction of ends 138 and handle 115. Therefore, latches 136 will hold bins 36 in a closed position while toolbox 10 is in transport, but will allow bins 36 to be opened upon application of an opening force thereon.

Once at a job site, latching shelf 118 may be opened by pulling upwardly on handle 128. Pulling upwardly on handle 128 causes locking arm 134 to be cammed horizontally away from locking pin 132. Therefore, with locking arm 134 free of locking pin 132 latching shelf 118 may be pivoted upwardly. To maintain latching shelf 118 in an extended position, shelf support 124 is pivoted so that lower end 126 abuts front plate 24. In this position, drawer 86 can be pulled outwardly from toolbox 10. By pulling outwardly on drawer 86, handle 115 is moved relative to latches 136. When latches 136 encounter the downwardly tapered portion of handle 115, ends 138 are cammed outwardly away from the handle, releasing latches 136 from handle 115. Thereafter, bins 36 may be pivoted outwardly to the position shown in FIG. 5.

It can therefore be seen that toolbox 10 solves many of the problems existing in prior art toolboxes. In use, tools may be placed on holding pins 52 and through holding members 48 in bins 36. Tray 68 may thereafter be placed in bin 36 to maintain the tools placed in holding member 48 and on holding pins 52 in position. Further, tools may be placed on holding pins 74 of tray 68. When bin 36 is pivoted inwardly to its closed position within toolbox 10, pins 74 cooperate with lower surfaces 30 of triangular supports 28 to insure that tools placed on pins 74 do not change position during transport. Still further, tools placed on holding pins 112 of drawer 86 are held in position through cooperation of holding pins 112 and retaining plate 40 of bins 36. Finally, bin 36 and drawer 86 are maintained in a closed position by latching shelf 118. Once at a particular job site, latching shelf 118 may be opened, allowing drawer 86 to be pulled away from toolbox 10. Drawer 86 may be completely removed from toolbox 10 if desired, as shown in FIG. 5. Further, bins 36 may be selectively opened by exerting an opening force thereon sufficient to release latches 136 from handle 115. Therefore, toolbox 10 can be completely opened at the job site so that all of its contents can be viewed by the mechanic.

From the foregoing, it will be seen that this invention is one well adapted to obtain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A toolbox for holding and transporting tools, comprising:

a generally rectangular frame, said frame forming an interior compartment, said frame having a front plate coupled thereto which defines a drawer opening;

at least one bin pivotally connected to said frame, said bin having a latch extending therefrom and into said interior compartment, said bin being pivotal about an axis generally perpendicular to said front plate and between an open position wherein said bin may be accessed and a closed position within said interior compartment wherein said bin may not be accessed; and a drawer slidingly received in said frame and through said drawer opening and having a handle extending upwardly therefrom, said latch of said bin mating with said handle when said bin is in said closed position and said drawer is received within said frame;

wherein the tools can be placed on said drawer and in said bin, and said drawer can be slid into the interior compartment of said frame, and said bin can be pivoted to said closed position, said latch cooperating with said handle to maintain said bin in a closed position.

2. The toolbox of claim 1, wherein a pair of said bins are provided on opposing sides of said frame.

3. The tool box of claim 2, wherein at least one of said latches is made of spring steel.

4. The toolbox of claim 3, wherein at least one of said latches has a bent rearward end and said handle is generally round, said rearward end being bent to matingly fit at least partially around said handle.

5. The toolbox of claim 4, further comprising a latching shelf pivotally mounted to said front plate, said latching shelf having a closed position against said front plate and an open position away from said front plate and in perpendicular relationship thereto.

6. A rolling toolbox, comprising:

a generally rectangular frame, said frame forming an interior compartment, said frame having a front plate, a rear plate and a top section coupled thereto, said front plate defining a drawer opening, said top section having a flat top surface and converging lower surfaces that extend into said interior compartment so that said top section is generally triangular;

a pair of bins pivotally connected to said frame, said bins each having an end plate, a retaining plate and opposing side plates that cooperate to form an interior;

a drawer slidingly received in said frame and through said drawer opening;

a latch coupled to said retaining plate of said bins, each said latch extending rearwardly into said interior compartment of said frame, each said latch having a bent rearward end; and a handle coupled to said drawer and extending upwardly therefrom, said handle cooperating with said rearward ends of said latches to maintain said bins in a closed position while the toolbox is being transported;

wherein said latches matingly fit at least partially around said handle when said bins are in a closed orientation, said latches being released from said handle upon the application of an opening force being exerted on said bins.

* * * * *